US011359148B2

(12) United States Patent
Koseoglu et al.

(10) Patent No.: US 11,359,148 B2
(45) **Date of Patent: *Jun. 14, 2022**

(54) METHODS AND SYSTEMS TO PRODUCE NEEDLE COKE FROM AROMATIC RECOVERY COMPLEX BOTTOMS

(71) Applicant: Saudi Arabian Oil Company, Dhahran (SA)

(72) Inventors: Omer Refa Koseoglu, Dhahran (SA); Robert Peter Hodgkins, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 97 days.

This patent is subject to a terminal disclaimer.

(21) Appl. No.: 16/575,148

(22) Filed: Sep. 18, 2019

(65) Prior Publication Data

US 2021/0079302 A1 Mar. 18, 2021

(51) Int. Cl.

| | |
|---|---|
| ***C10G 57/00*** | (2006.01) |
| ***C10B 57/04*** | (2006.01) |
| ***C10B 55/00*** | (2006.01) |
| ***C10B 57/00*** | (2006.01) |
| ***C10B 57/08*** | (2006.01) |

(52) U.S. Cl.

CPC ..... *C10B 57/04* (2013.01); *C10B 55/00* (2013.01); *C10B 57/005* (2013.01); *C10B 57/08* (2013.01)

(58) Field of Classification Search

CPC ..... C10B 55/00; C10B 57/005; C10B 57/04; C10B 57/045; C10B 57/08; C10G 69/06; C10G 2300/1096

See application file for complete search history.

(56) References Cited

U.S. PATENT DOCUMENTS

| | | | | |
|---|---|---|---|---|
| 4,061,562 | A | 12/1977 | McKinney et al. | |
| 7,645,375 | B2 | 1/2010 | Varadaraj et al. | |
| 8,894,841 | B2 | 11/2014 | Koseoglu | |
| 10,053,401 | B1 * | 8/2018 | Beadle | C07C 4/26 |
| 10,093,873 | B2 | 10/2018 | Koseoglu | |
| 2019/0241486 | A1 | 8/2019 | Koseoglu et al. | |

FOREIGN PATENT DOCUMENTS

| | | | |
|---|---|---|---|
| EP | 1751253 | B1 | 8/2015 |
| GB | 2415434 | * | 12/2005 |

OTHER PUBLICATIONS

International Search Report and Written Opinion for related PCT application PCT/US2020/051173 dated Dec. 1, 2020, pp. 1-15.

Wang, G.; "Molecular Composition of Needle Coke Feedstocks and Mesophase Development during Carbonization" A THesis in Material Science and Engineering; XP055750976, URL: https://etda.libraries.psu.edu/files/final_submissions/2129; Dec. 2005; pp. 1-229.

(Continued)

*Primary Examiner* — Prem G Singh

*Assistant Examiner* — Brandi M Doyle

(74) *Attorney, Agent, or Firm* — Bracewell LLP; Constance G. Rhebergen; Eleanor L. Tyson

(57) ABSTRACT

Provided here are systems and methods of production of needle coke by processing an aromatic rejects stream containing long chain alkyl monoaromatics and bridged diaromatics through a delayed coking process. Various other embodiments may be disclosed and claimed.

15 Claims, 2 Drawing Sheets

(56) References Cited

OTHER PUBLICATIONS

Halim, et al., "Preparation of needle coke from petroleum by-products", Carbon Letters vol. 14, No. 3, pp. 152-161, 2013, Daejeon, Korea.
SSV Ramakumar, "Needle Coke Technology", Indian Oil Corporation, 2012.
Tandon, et al., "Needle Coke Quality—Effect of Operating Parameters", Indian Institute of Petroleum, Dehradun, India, 2010.
U.S. Appl. No. 16/424,273, "Systems and Processes for Suppressing Heavy Polynuclear Aromatic Deposition in a Hydrocracking Process", filed May 28, 2019.
U.S. Appl. No. 16/554,057, "Low-Sulfur Aromatic-Rich Fuel Oil Blending Component", filed Aug. 28, 2019.

* cited by examiner

METHODS AND SYSTEMS TO PRODUCE NEEDLE COKE FROM AROMATIC RECOVERY COMPLEX BOTTOMS

TECHNICAL FIELD

The disclosure relates to processing of heavy aromatic hydrocarbons from an aromatic recovery complex.

BACKGROUND

Coking is a refinery unit operation that upgrades material called bottoms from the atmospheric or vacuum distillation column into higher-value products. Two types of coking processes exist—delayed coking and fluid coking. Both are physical processes that occur at pressures slightly higher than atmospheric and at temperatures greater than about 900° F. that thermally crack the feedstock into products such as naphtha and distillate and produce petroleum green coke.

In a delayed coking process, fresh feedstock is introduced into a fractionator. The fractionator bottoms including heavy recycle material is also introduced along with the fresh feedstock. The feedstock is passed through a furnace and heated to a coking temperature. The hot feed is then supplied to a coke drum, where it cracked to form light products. The heavy free radical molecules form heavier polynuclear aromatic compounds, which are referred to as "coke."

With a short residence time in the furnace, coking of the feed is thereby "delayed" until it is discharged into a coking drum. The volatile components are recovered as coker vapor and returned to the fractionator. The coke is deposited on the interior of the drum. When the coke drum is full of coke, the feed is switched to another drum and the full drum is cooled and emptied by conventional methods, such as by hydraulic means or by mechanical means. The temperatures and length of coking times of the coking operation along with the post-coking treatments dictate the quality of the coke. Typical coking unit feedstocks are vacuum residues derived from fossil fuels. Vacuum residue samples derived from crude oils from various geographical regions typically have low American Petroleum Institute (API) gravities in the range of from 1 to 20 degrees and a sulfur content that ranges from 0.2 to 7.7 weight percent. These vacuum residues are rich in nitrogen and can contain metals, such as nickel and vanadium in relatively large concentrations, which make them difficult to process in other refinery unit operations.

SUMMARY

A need has been recognized for the production of needle coke during processing of hydrocarbons. Certain embodiments include methods and systems for production of needle coke products. One such method includes the steps of: (a) supplying a feed stream containing one or more of heavy alkyl aromatic compounds and alkyl-bridged non-condensed alkyl multi-aromatic compounds from an aromatic complex to a heating unit to produce a heated aromatic stream; (b) supplying the heated aromatic stream to a coking unit under coking conditions to produce a coker vapor, a liquid product stream, and a petroleum coke product; and (c) removing the petroleum coke product from the coking unit and supplying the petroleum coke product to a calcination unit to produce a needle coke product. In some embodiments disclosed here, calcination converts 'green coke' to high-quality needle coke. Calcination can remove residual hydrocarbons. The quality of the resulting coke after calcination, in some embodiments, depends in part on how 'green coke' was formed in a delayed coker unit.

In an embodiment, the feed stream contains low levels of sulfur (<5 ppmw) and nitrogen (<5 ppmw), and a negligible amount of metals, such as nickel and vanadium. In some embodiments, sulfur is present at between about 0.1 ppmw and about 0.2 to about 0.5 wt. %. In some embodiments, nitrogen is present at between about 0.1 ppmw and about 50 ppmw. Density of the aromatics bottoms stream can be between about 0.83 g/cm$^3$ and about 1.1 g/cm$^3$, and in some embodiments between about 0.9 g/cm$^3$ and about 1.1 g/cm$^3$. In some embodiments, nickel and vanadium concentrations are below about 7 ppmw.

The feed stream can be derived from a xylene rerun column of an aromatic recovery process. The feed stream can contain $C_{9+}$ compounds and can be supplied from a fractionator adapted to fractionate a stream from the xylene rerun column. The xylene rerun column receives a $C_{8+}$ stream. This $C_{8+}$ stream is fractionated to remove $C_8$ components and produce a $C_{9+}$ stream. The $C_{9+}$ stream is referred to as the bottoms/reject stream, which is used as a feedstock in embodiments described here. In an embodiment, the one or more of heavy alkyl aromatic compounds and alkyl-bridged non-condensed alkyl multi-aromatic compounds are $C_{11+}$ compounds, where $C_9$ and $C_{10}$ compounds are removed from the feed stream.

The coking conditions can include a temperature ranging from about 450° C. to about 510° C., or in some embodiments between about 440° C. to about 530° C. The coking conditions can include an initial pressure between about 1 bar to about 3 bars, or about 1 bar to about 5 bars, and can include an increased pressure, under increased temperature, ranging from about 1 bar to about 70 bars, or from about 59 bars to about 66 bars. Coking pressure depends, in some embodiments in part, on generation of light end gases and venting of such gases. In an embodiment, the method includes removing the coker vapor and the liquid product stream from the coking unit, and supplying water to the coking unit to quench a portion of the petroleum coke product before removing the petroleum coke product from the coking unit.

In an embodiment, the process includes the steps of: (a) supplying a feed stream containing one or more of heavy alkyl aromatic compounds and alkyl-bridged non-condensed alkyl multi-aromatic compounds from an aromatic complex to hydrodearylation reactor to react in presence of a catalyst under specific reaction conditions to yield a first product stream containing hydrogen, $C_1$ to $C_4$ gases, benzene, toluene, xylenes, and $C_{9+}$ compounds; (b) supplying the first product stream to a separation unit to produce a hydrodearylated stream containing $C_{9+}$ compounds and a second product stream containing hydrogen, $C_1$ to $C_4$ gases, benzene, toluene, and xylenes; (c) supplying the hydrodearylated stream containing $C_{9+}$ compounds to a heating unit to produce a heated aromatic stream; (d) supplying the heated aromatic stream to a coking unit under coking conditions to produce a coker vapor, a liquid product stream, and a petroleum coke product; and (e) removing the petroleum coke product from the coking unit and supplying the petroleum coke product to a calcination unit to produce a needle coke product.

The feed stream can be derived from a xylene rerun column of an aromatic recovery process. The coking conditions can include a temperature ranging from about 450° C. to about 510° C., or from about 440° C. to about 530° C. The coking conditions can include an initial pressure ranging from about 1 bar to about 5 bars, and optionally an increased pressure ranging from about 1 bar to about 70 bars, or from about 59 bars to about 66 bars, depending in part on venting of produced gases.

In an embodiment, the method includes removing the coker vapor and the liquid product stream from the coking unit, and supplying water to the coking unit to quench a portion of the petroleum coke product before removing the petroleum coke product from the coking unit. In some embodiments, conditions in the hydrodearylation reactor include an operating temperature in the range of about 200° C. to about 450° C., for example about 350° C. The specific reaction conditions in the hydrodearylation reactor can include an operating pressure in the range of about 5 bar gauge to 80 bar gauge. The specific reaction conditions in the hydrodearylation reactor can include a volumetric ratio of hydrogen to the hydrocarbon components in the hydrodearylation reactor in a range from 50 to 2500 $Nm^3/m^3$.

BRIEF DESCRIPTION OF THE DRAWINGS

Embodiments will be readily understood by the following detailed description in conjunction with the accompanying drawings. Embodiments are illustrated by way of example and not by way of limitation in accompanying drawings.

DETAILED DESCRIPTION

Figure 1:
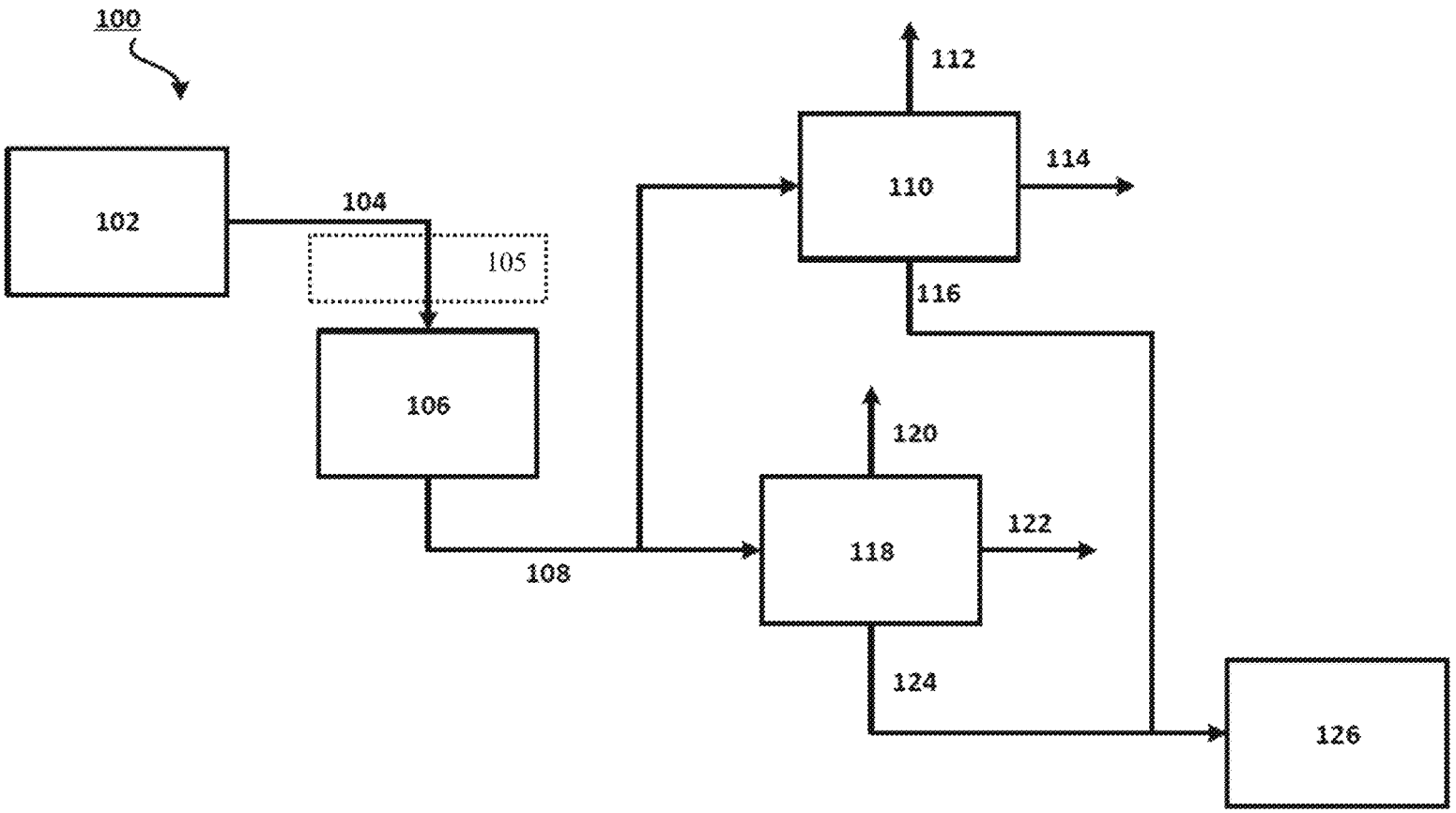
FIG. 1 is a schematic representation of an aromatics processing system that includes a delayed coking unit.

The present disclosure describes various embodiments related to processes, devices, and systems for production of needle coke from an aromatic bottoms stream, comprising long chain alkyl mono-aromatics, and both bridged, non-condensed and condensed di-aromatics, from an aromatic recovery complex. Further embodiments are described and disclosed.

In the following description, numerous details are set forth in order to provide a thorough understanding of the various embodiments. In other instances, well-known processes, devices, and systems may not have been described in particular detail in order not to unnecessarily obscure the various embodiments. Additionally, illustrations of the various embodiments may omit certain features or details in order to not obscure the various embodiments. Here, reference is made to the accompanying drawings that form a part of this disclosure. The drawings may provide an illustration of some of the various embodiments in which the subject matter of the present disclosure may be practiced. Other embodiments may be utilized, and logical changes may be made without departing from the scope of this disclosure. Therefore, the following detailed description is not to be taken in a limiting sense.

The description may use the phrases "in some embodiments," "in various embodiments," "in an embodiment," or "in embodiments," which may each refer to one or more of the same or different embodiments. Furthermore, the terms "comprising," "including," "having," and the like, as used with respect to embodiments of the present disclosure, are synonymous.

As used in this disclosure, the term "hydrodearylation" refers to a process for cleaving of the alkyl bridge of non-condensed alkyl-bridged multi-aromatics or heavy alkyl aromatic compounds to form alkyl mono-aromatics, such as toluene, benzene, and xylene, in the presence a catalyst and hydrogen.

As used in this disclosure, the term "stream" (and variations of this term, such as hydrocarbon stream, feed stream, product stream, and the like) may include one or more of various hydrocarbon compounds, such as straight chain, branched or cyclical alkanes, alkenes, alkadienes, alkynes, alkyl aromatics, alkenyl aromatics, condensed and non-condensed di-, tri- and tetra-aromatics, and gases such as hydrogen and methane, $C_{2+}$ hydrocarbons and further may include various impurities.

As used in this disclosure, the term "rich" means an amount of at least 30% or greater, by mole percentage of a compound or class of compounds in a stream. Certain streams rich in a compound or class of compounds can contain about 50% or greater, by mole percentage of the particular compound or class of compounds in the streams. In certain cases, mole percentage may be replaced by weight percentage, in accordance with standard industry usage.

As used in this disclosure, the term "mixed xylenes" refers to a mixture containing one or more $C_8$ aromatics, including any one of the three isomers of di-methylbenzene and ethylbenzene.

The methods and systems disclosed here result in conversion of a low value fuel oil to premium value products, such as needle coke, benzene, toluene, and xylenes. Catalytic reformers produce reformate, an aromatic-rich gasoline blending fraction or feedstock for production of benzene, toluene, and xylenes (BTX). The aromatic complex produces a reject stream or bottoms containing multiple aromatic rings or mono-aromatic compounds with heavy ($C_{3+}$) alkyl groups whose boiling point ranges from 100° C.-450° C. The reject stream has limited applications as a gasoline blending component, due to environmental regulations.

Due to the stringent fuel specifications implemented or being implemented worldwide, requiring less than 35 volume percent (vol. %) of BTX and less than 1 vol. % of benzene in gasoline, the reformate fraction has to be further treated to reduce its aromatics content. The reformate fraction can be subject to benzene hydrogenation or BTX extraction. In the benzene hydrogenation process, the reformate is hydrogenated to reduce the benzene content and the total BTX content is reduced by blending if needed. In the BTX extraction process, the reformate is sent to an aromatic complex to extract benzene, toluene, and xylenes, which have a premium value, and to produce an aromatics- and benzene-free gasoline blending component. This disclosure is directed to methods and systems of production of needle coke by processing an aromatic rejects stream containing long chain alkyl monoaromatics and bridged diaromatics through a delayed coking process.

The aromatic rejects stream has a volumetric mass density of about 0.982 and a Bureau of Mines Correlation Index (BMCI) of about 97, and contains nitrogen less than about 30 parts per million weight (ppmw), in some embodiments. In an embodiment, the aromatic rejects stream contains minimal levels of sulfur (<5 ppmw), nitrogen, and metals, such as nickel and vanadium. The sulfur content can range from 0 to 200 ppmw. The nitrogen content can range from 0 to 200 ppmw.

In an embodiment, the aromatic rejects stream (bottoms stream) that is supplied to the coking unit contains less than 30 wt. % of alkyl mono-aromatic compounds. In an embodiment, this aromatic rejects stream contains less than 20 wt. % of alkyl mono-aromatic compounds. In an embodiment, this aromatic rejects stream contains less than 10 wt. % of alkyl mono-aromatic compounds. In an embodiment, this aromatic rejects stream contains greater than 40 wt. % of di-aromatic compounds. In an embodiment, this aromatic rejects stream contains greater than 50 wt. % of di-aromatic compounds. In an embodiment, this aromatic rejects stream contains greater than 60 wt. % of di-aromatic compounds.

In certain other embodiments, the aromatic rejects stream that is supplied to the coking unit contains between about 5 wt. % and about 99 wt. % mono-aromatic compounds and contains between about 2 wt. % and about 80 wt. % di-aromatic compounds. In example $C_{9+}$ feeds, mono-aromatic compounds can be at about 75 wt. % and di-aromatics can be at about 15.5 wt. % or mono-aromatic compounds can be at about 94 wt. % and di-aromatics can be at about 4 wt. %. In other example $C_{11+}$ feeds, mono-aromatic compounds can be at about 15 wt. % and di-aromatics can be at about 63 wt. %, or mono-aromatics can be at about 9 wt. % and di-aromatics can be at about 68 wt. %.

In an embodiment, an aromatic rejects stream from an aromatic recovery complex is supplied to a heating zone to produce a heated aromatic stream. The $C_{9+}$ stream from a xylene rerun column is produced at about 300° C. If the stream comes from storage it is at about 30° C. The heating zone can heat the aromatics stream to between about 400° C. and about 600° C. This heated aromatic stream is then supplied to a delayed coking zone to form a petroleum green coke product. The vapor products from this coking process are collected overhead and returned to the fractionator. The vapor will be distilled and products boiling at 180° C. and less will be sent to the aromatic recovery complex, or can be mixed with a reformate stream. If the fractionator can separate benzene, toluene and xylenes, the streams can be mixed with $C_6$, $C_7$ and $C_8$ streams in the aromatic recovery complex. In certain embodiments, the petroleum green coke product is subject to calcination that includes drying, devolatization, and densification. Calcination of the petroleum green coke is carried out at conditions familiar to those of ordinary skill in the art at prior art conditions.

In an embodiment, the petroleum green coke is subjected to temperatures ranging from 1150° C. to 1350° C. or greater to achieve desired density and conductivity of the final needle coke product. In an embodiment, the petroleum green coke product is subject to thermal processing at very high temperatures to produce a substantially free-flowing needle coke product. Coke product was identified and characterized using Raman spectroscopy, and the coke product produced by systems and methods of the present disclosure is needle coke quality. In an embodiment, the non-condensed diaromatics are further processed to produce BTX. Selecting the aromatic stream with lesser content of sulfur and metals has led to production of needle coke without the need for desulfurization and demetallization processes.

In an embodiment, the aromatic rejects stream from an aromatics recovery complex is supplied to a catalytic hydrodearylation process, where the long chain alkyl mono-aromatics and bridged di-aromatics are converted to mono-aromatic compounds. This stream containing the mono-aromatic compounds is subjected to a fractionation step, where the $C_1$-$C_4$ gases, benzene, xylenes, and toluene and other components are separated from the fraction containing the $C_{9+}$ compounds. This fraction containing the $C_{9+}$ compounds is then supplied to a heating zone to produce a heated aromatic heavy oil stream. In some embodiments, the stream entering the delayed coking unit can also be a $C_{11+}$ stream, where the $C_{9+}$ stream is subjected to fractionation to remove the $C_9$ and $C_{10}$ components.

This heated aromatic heavy oil stream is then supplied to a delayed coking zone to form a petroleum green coke product. This petroleum green coke product is subject to thermal processing at very high temperatures to produce a needle coke product. In this embodiment, the process reject or bottoms is supplied (either whole or fractionated) as feedstock to a hydrodearylation reactor for processing before supplying the hydrodearylated product stream for further processing by a coking unit. In an embodiment, the process reject or bottoms is mixed with an excess of hydrogen gas in a mixing unit before being supplied to a hydrodearylation reactor. In an embodiment, the hydrodearylated product stream is supplied to a separation unit. This separation unit can include one or more fractionation columns.

An embodiment can include a distillation column with several theoretical trays or a flash vessel or a stripper. The hydrodearylated product stream is separated in the separation unit to produce a first product stream and a bottoms $C_{9+}$ stream. The first product stream contains hydrogen, $C_1$ to $C_4$ gases, benzene, toluene, and xylenes. In an embodiment, this first product stream is supplied to a benzene extraction unit to produce a benzene-rich stream and a stream containing the xylenes that can be processed to recover xylenes. The bottoms $C_{9+}$ stream is supplied to a heating zone to produce a heated aromatic stream. This heated aromatic stream is then supplied to a delayed coking zone to form a petroleum green coke product. The vapor products from this coking process are collected overhead and returned to the fractionator. In certain embodiments, the petroleum green coke product is subject to calcination process to produce the needle coke product.

In a refinery with an aromatic complex, whole crude oil is distilled in an atmospheric distillation column to recover a naphtha fraction (compounds with a boiling point ranging from 36° C. to 180° C.), a diesel fraction (compounds with a boiling point ranging from 180° C. to 370° C.), and an atmospheric residue fraction (compounds with a boiling point of 370° C. and higher). The naphtha fraction is hydrotreated in a naphtha hydrotreating unit to produce a hydrotreated naphtha fraction that has a sulfur and nitrogen content of less than 0.5 ppmw. This hydrotreated naphtha fraction is sent to a catalytic reforming unit to improve properties, such as an increase in the octane number to produce a gasoline blending stream or feedstock for an aromatics recovery unit. The reformate fraction from this catalytic reforming unit can be used as a gasoline blending component or sent to an aromatic complex to recover benzene, toluene, and xylenes. The diesel fraction is hydrotreated in a separate hydrotreating unit to desulfurize the diesel fraction to obtain diesel oil that contains less than 10 ppm of sulfur.

The atmospheric residue fraction is either used a fuel oil component or sent to other separation or conversion units to convert the low value hydrocarbon components to high value products. In an aromatic recovery complex, the reformate from the catalytic reforming unit is separated into two fractions: a light reformate containing $C_5$ to $C_6$ compounds and a heavy reformate containing $C_{7+}$ compounds. The light reformate is sent to a benzene extraction unit to extract the benzene and recover substantially benzene-free gasoline. The heavy reformate stream is sent to a p-xylene extraction unit to recover p-xylene. Other xylenes are recovered and sent to xylene isomerization unit to convert them to p-xylene. The converted fraction is recycled to the p-xylene extraction unit. The heavy $C_{9+}$ fraction from the xylene re-run unit is recovered as process reject or bottoms. The aromatic rejects stream is directed to a delayed coking process. Here, the aromatic rejects stream is introduced into a furnace and heated to a coking temperature, between about 440° C. to about 530° C. or between about 480° C. to about 530° C.

The heated aromatic stream is then supplied to a coking unit maintained at coking conditions. In an embodiment, the coking unit is a delayed coking unit with two drums operating alternatively. The coking conditions include a temperature ranging from 425° C. to 650° C. In certain embodiments, the temperature can range from 425° C. to 540° C. In certain embodiments, the temperature can range from 450° C. to 510° C. In certain embodiments, the temperature can range from 470° C. to 500° C. The coking conditions include a pressure ranging from 1 bar to 70 bars. In certain embodiments, the pressure can range from about 1 bar to about 30 bars, or from about 1 bar to about 10 bars, or from about 1 bar to about 5 bars, depending on venting of produced light gases during coking. In certain embodiments, the pressure can range from 10 bar to 70 bars or 40 bar to 70 bars, depending on venting of light gases.

The coking cycle time can range from 1 hour to 60 hours. In certain embodiments, the coking cycle time can range from 24 hours to 48 hours. The coking cycle time can range from 1 hour to 10 hours. The coking cycle time can range from 5 hours to 24 hours. The heated aromatic stream is cracked to form three main products: gas products or coker vapor ($C_1$ to $C_4$ compounds), liquid products (hydrocarbons boiling above 36° C.), and solid products. The coker vapor and the liquid products are each supplied to fractionation units to produce various products of desired cuts.

Naphtha fraction products can be sent directly to an aromatic recovery complex. Diesel range products can be sent to a diesel pool, diesel hydrotreating unit, hydrocracking unit, and/or back to the atmospheric distillation column. The solid products or the petroleum green coke products are subject to further treatment or processing to produce fuel grade (shot) coke, anode grade coke (sponge) or electrode grade coke (needle). The quality of the petroleum green coke product depends on the quality of the feedstock processed. Feedstocks containing high concentrations of asphaltenes, metal and sulfur content produce fuel grade coke. Feedstocks with low level of contaminants produce higher grade coke, such as anode or needle grade coke. The properties of different types of cokes are shown in Table 1.

TABLE 1

| Property | Fuel Coke | Sponge Coke | Needle Coke |
|---|---|---|---|
| Bulk Density (kilogram per cubic meter) | 880 | 720-800 | 670-720 |
| Sulfur (maximum weight percent) | 3.5-7.5 | 1.0-3.5 | 0.2-0.5 |
| Nitrogen (maximum parts per million weight) | 6,000 | negligible | 50 |
| Nickel (maximum parts per million weight) | 500 | 200 | 7 |
| Vanadium (maximum parts per million weight) | 150 | 350 | negligible |
| Volatile combustible material (maximum weight percent) | 12 | 0.5 | 0.5 |
| Ash content (maximum weight percent) | 0.35 | 0.40 | 0.1 |
| Moisture content (maximum weight percent) | 8-12 | 0.3 | 0.1 |
| Hardgrove Grindability Index (HGI) (weight percent) | 35-70 | 60-100 | negligible |

Here, aromatic complex bottoms streams contains minimal levels of sulfur (<5 ppmw), nitrogen (<5 ppmw), and metals, such as nickel and vanadium. This stream has proved to be a superior feedstock for needle coke production, as shown by way of the Examples.

Referring now to FIG. 1, in an embodiment 100, an aromatic bottoms stream 104 from an aromatic recovery complex 102 is supplied to a furnace 106. Furnace 106 is optionally preceded by a hydrodearylation reactor and/or a fractionator 105, in some embodiments. The furnace 106 is operated at a temperature ranging from about 440° C. to about 530° C. The heated aromatic stream 108 is supplied to a first coking drum 110 under delayed coking conditions to produce a coker vapor stream 112 containing $C_1$ to $C_4$ compounds and a liquid product stream 114. The coker vapor stream 112 and the liquid product stream 114 are each supplied to fractionation units to produce various products of desired cuts in boiling point. Optional hydrodearylation reactor and/or a fractionator 105 can process and/or separate certain lower molecular weight compounds before furnace 106 such that compounds entering furnace 106 may include only $C_{9+}$, $C_{10+}$, or $C_{11+}$ compounds.

The petroleum green coke is deposited on the interior of the first coking drum 110. When the coke drum is full of coke, the supply of the heated aromatic stream 108 is switched to a second coking drum 118. The full drum 110 is cooled and the solid products are removed and supplied via stream 116 to a calcination unit 126. In an embodiment, the petroleum green coke formed in the first coking drum 110 is removed using high pressure water jets and then supplied to a calcination unit 126 to produce the needle coke product.

When the second coking drum 118 is operational, the heated aromatic stream 108 is cracked under delayed coking conditions to produce a coker vapor stream 120 containing $C_1$ to $C_4$ compounds and a liquid product stream 122. The coker vapor stream 120 and the liquid product stream 122 are each supplied to fractionation units to produce various products of desired cuts in boiling point. The petroleum green coke is deposited on the interior of the second coking drum 118. The petroleum green coke formed in the second coking drum 118 is removed using high pressure water jets and then supplied via stream 124 to a calcination unit 126 to produce the needle coke product.

The following examples illustrate certain embodiments of the methods of production of needle coke from an aromatic rejects stream. While the particular examples provided below include feedstocks containing $C_{11+}$ compounds, the methods and systems for production of needle coke can utilize feedstocks containing $C_{9+}$ compounds and $C_{10+}$ compounds.

Example 1

An aromatic complex bottoms stream containing $C_{11+}$ hydrocarbons (100 grams) was subjected to delayed coking. The aromatic complex bottoms stream had a density of 0.9819 grams per cubic centimeter and sulfur and nitrogen at <38 and 0.04 ppmw, respectively. The boiling point properties of the aromatic complex bottoms stream were determined using the ASTM D2887 method, and the results are shown in Table 2.

TABLE 2

| Property | Boiling Point, ° C. |
|---|---|
| Initial Boiling Point | 198 |
| 5 wt. % | 207 |
| 10 wt. % | 211 |
| 30 wt. % | 237 |
| 50 wt. % | 275 |

TABLE 2-continued

| Property | Boiling Point, ° C. |
|---|---|
| 70 wt. % | 303 |
| 90 wt. % | 332 |
| 95 wt. % | 351 |
| Final Boiling Point | 446 |

The properties of the aromatic recovery complex bottoms stream containing $C_{11+}$ hydrocarbons as determined by comprehensive two-dimensional gas chromatography are summarized in Table 3.

TABLE 3

| Components | Weight percent % |
|---|---|
| Paraffins | 0.04 |
| Naphthenes | 0.30 |
| Di-Naphthenes | 0.26 |
| Mono Aromatics | 13.04 |
| Naphtheno-Mono-Aromatics | 12.65 |
| Di-Aromatics | 60.48 |
| Biphenyls | 1.95 |
| Naphtheno-Di Aromatics | 6.68 |
| Tri-Aromatics | 3.35 |
| Tetra-Aromatics | 1.25 |

The coking conditions include temperature of 475° C., 1 bar of pressure at ambient conditions, and 65.6 bars of pressure at 475° C. for 2.2 hours. The example was performed in an autoclave that was isolated. Therefore, the pressure increase in this example was an autogenous pressure increase. Lesser pressures can exist in industrial application with venting of produced coker gases.

Figure 2:
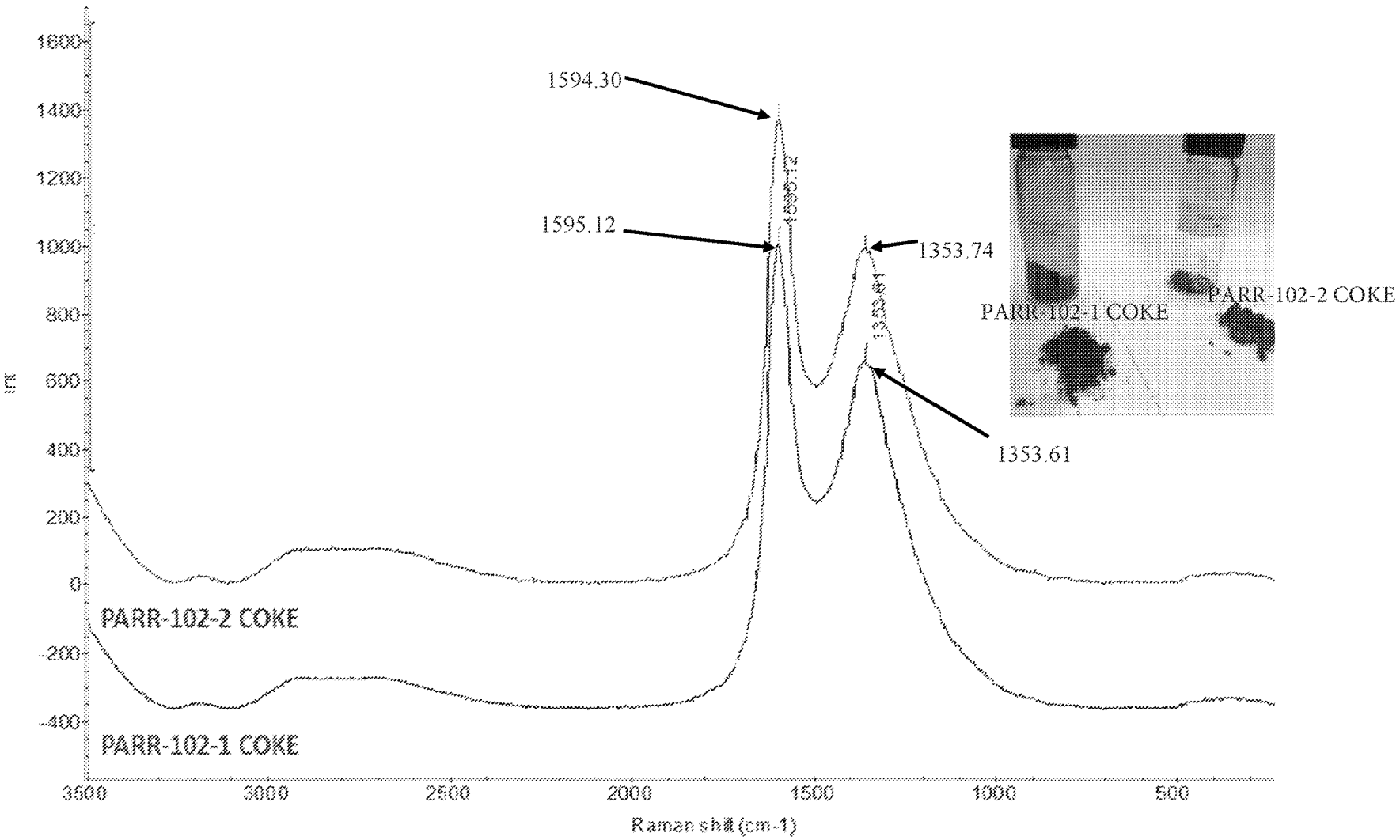
FIG. 2 shows Raman spectroscopy characterization of needle coke products produced according to embodiments of the present disclosure.

The experiment simulated a delayed coker unit, which runs at lesser pressure, between about 1-5 bar, since produced gases are removed from the system in industrial applications. At the end of 2.2 hours, the autoclave was cooled to ambient temperature. The gas phase products were vented out, and the liquid products and the coke were collected. This experiment yielded 54.1 wt. % of gas products, 32.3 wt. % of liquid, and 13.8 wt. % of needle coke solid. Raman spectroscopy, shown in FIG. 2, was used to characterize the needle coke, and properties are shown in Table 4.

TABLE 4

| | | (Method: TGA) | | | |
|---|---|---|---|---|---|
| | | PARR-102-1 Coke Samples | | PARR-102-2 Coke Samples | |
| Item No. | Properties | PARR-102/1-1 (wt. %) | PARR-102/1-2 (wt. %) | PARR-102/2-1 (wt. %) | PARR-102/2-2 (wt. %) |
| 1 | Total Moisture (@110° C.) | 1.8 | 1.9 | 0.6 | 1.2 |
| 2 | Volatile Matter (@900° C.) | 13.3 | 14.6 | 6.4 | 9.7 |
| 3 | Fixed Carbon | 84.5 | 82.5 | 92.8 | 88.6 |
| 4 | Ash Content (@900° C.) | 0.4 | 1.0 | 0.2 | 0.5 |
| | Total | 100 | 100 | 100 | 100 |

Example 2

An aromatic complex bottoms stream containing $C_{11+}$ hydrocarbons (50 grams) was subjected to delayed coking at 476° C., 1 bar of pressure at ambient conditions and 59 bars of pressure at 476° C. for 6.1 hours. After the experiment ended, the autoclave was cooled to 15° C. and kept in an ice bath for an hour. The gas phase products were vented out, and the liquid products and the coke were collected. This experiment yielded 17.4 wt. % of gas, 55.8 wt. % of liquid and 26.8 wt. % of needle coke. The experiment was run under autogeneous pressure. The additional feed volume added to the fixed volume autoclave reduced the volume in the head space, and therefore, the pressure increase for this example derived in part from the extra feed volume. The additional feed volume produced more coke product. To make needle coke from vacuum residue at this quality would require severe hydrotreating.

The properties of the needle coke produced in this experiment as compared to the standard properties of a needle coke are shown in Table 5.

TABLE 5

| Property | Needle coke specification | Needle coke produced |
|---|---|---|
| Sulfur (wt. %) | 0.2-0.5 | <0.2 |
| Nitrogen (ppmw) | 50 | 0 |
| Nickel (ppmw) | 7 | 0 |
| Vanadium (ppmw) | — | 0 |
| Volatile combustible material (wt. %) | 0.5 | 0 |
| Ash content (wt. %) | 0.1 | 0 |
| Moisture content (wt. %) | 0.1 | 0 |

Ranges may be expressed herein as from about one particular value and to about another particular value. When such a range is expressed, it is to be understood that another embodiment is from the one particular value and/or to the other particular value, along with all combinations within said range. Where the range of values is described or referenced here, the interval encompasses each intervening value between the upper limit and the lower limit as well as the upper limit and the lower limit and includes smaller ranges of the interval subject to any specific exclusion provided. Where a method comprising two or more defined steps is recited or referenced herein, the defined steps can be carried out in any order or simultaneously except where the context excludes that possibility. While various embodiments have been described in detail for the purpose of illustration, they are not to be construed as limiting, but are intended to cover all the changes and modifications within the spirit and scope thereof.

The term about as used herein includes plus or minus 5% of the value or range provided.

What is claimed is:

1. A process for production of a needle coke product, the process comprising the steps of:

supplying a feed stream containing one or more of heavy alkyl aromatic compounds and alkyl-bridged non-condensed alkyl multi-aromatic compounds from an aromatic complex to a heating unit to produce a heated aromatic stream, wherein the heated aromatic stream contains between about 0 to about 200 ppmw sulfur;

supplying the heated aromatic stream to a coking unit with one coking drum under coking conditions to produce a coker vapor, a liquid product stream, and a petroleum coke product; and removing the petroleum coke product from the one coking drum and supplying the petroleum coke product to a calcination unit to produce a needle coke product.

2. The process of claim 1, wherein the feed stream is derived from a xylene rerun column of an aromatic recovery process.

3. The process of claim 2, wherein the feed stream contains $C_{9+}$ compounds and is supplied from a fractionator adapted to fractionate a stream from the xylene rerun column to the feed stream.

4. The process of claim 1, wherein the one or more of heavy alkyl aromatic compounds and alkyl-bridged non-condensed alkyl multi-aromatic compounds are $C_{11+}$ compounds.

5. The process of claim 1, wherein the coking conditions include a temperature ranging from about 440° C. to about 530° C.

6. The process of claim 1, wherein the coking conditions include a pressure ranging from about 1 bar to about 70 bars.

7. The process of claim 1, further comprising the steps of:

removing the coker vapor and the liquid product stream from the coking unit; and supplying water to the coking unit to quench a portion of the petroleum coke product before removing the petroleum coke product from the coking unit.

8. A process for production of a needle coke product, the process comprising the steps of:

supplying a feed stream containing one or more of heavy alkyl aromatic compounds and alkyl-bridged non-condensed alkyl multi-aromatic compounds from an aromatic complex to a hydrodearylation reactor to react in presence of a catalyst and hydrogen under specific reaction conditions to yield a first product stream containing hydrogen, $C_1$ to $C_4$ gases, benzene, toluene, xylenes, and $C_{9+}$ compounds;

supplying the first product stream to a separation unit to produce a hydrodearylated stream containing $C_{9+}$ compounds and a second product stream containing hydrogen, $C_1$ to $C_4$ gases, benzene, toluene, and xylenes;

supplying the hydrodearylated stream containing $C_{9+}$ compounds to a heating unit to produce a heated aromatic stream, wherein the heated aromatic stream contains between about 0 to about 200 ppmw sulfur;

supplying the heated aromatic stream to a coking unit with one coking drum under coking conditions to produce a coker vapor, a liquid product stream, and a petroleum coke product; and removing the petroleum coke product from the one coking drum and supplying the petroleum coke product to a calcination unit to produce a needle coke product.

9. The process of claim 8, wherein the coking conditions include a temperature ranging from about 440° C. to about 530° C.

10. The process of claim 8, wherein the coking conditions include a pressure ranging from about 1 bar to about 70 bars.

11. The process of claim 8, further comprising the steps of:

removing the coker vapor and the liquid product stream from the coking unit; and supplying water to the coking unit to quench a portion of the petroleum coke product before removing the petroleum coke product from the coking unit.

12. The process of claim 8, wherein the feed stream is from a xylene rerun column of an aromatic recovery process.

13. The process of claim 8, wherein conditions in the hydrodearylation reactor include an operating temperature in the range of about 200° C. to about 450° C.

14. The process of claim 8, wherein conditions in the hydrodearylation reactor include an operating pressure in the range of about 5 bar gauge to about 80 bar gauge.

15. The process of claim 8, wherein a volumetric ratio of hydrogen to hydrocarbon components in the hydrodearylation reactor ranges from 50 to 2500 $Nm^3/m^3$.

* * * * *